US008256276B2

(12) United States Patent
Pan et al.

(10) Patent No.: US 8,256,276 B2
(45) Date of Patent: Sep. 4, 2012

(54) BALL MOVEMENT PATH MEASURING METHOD

(75) Inventors: Francis Chung Hwa Pan, Taichung (TW); Chin-Chieh Chu, Taichung County (TW); Fu-Chin Chuang, Changhua County (TW)

(73) Assignee: Francis Chung Hwa Pan, Taichung (TW)

( * ) Notice: Subject to any disclaimer, the term of this patent is extended or adjusted under 35 U.S.C. 154(b) by 218 days.

(21) Appl. No.: 12/782,214

(22) Filed: May 18, 2010

(65) Prior Publication Data

US 2011/0283782 A1 Nov. 24, 2011

(51) Int. Cl.
*A63B 53/00* (2006.01)

(52) U.S. Cl. ..... 73/65.03; 73/760

(58) Field of Classification Search ..... 73/65.01–65.03, 73/65.07, 760

See application file for complete search history.

(56) References Cited

U.S. PATENT DOCUMENTS 5,333,874 A * 8/1994 Arnold et al. ..... 473/156
5,779,555 A * 7/1998 Nomura et al. ..... 473/223
6,536,763 B1 * 3/2003 Braun ..... 273/118 R
6,551,194 B2 * 4/2003 Hammerquist ..... 473/145
7,744,482 B1 * 6/2010 Watson ..... 473/221
7,932,908 B1 * 4/2011 Ueshima et al. ..... 345/474
2011/0269517 A1 * 11/2011 Englert et al. ..... 463/7

* cited by examiner

*Primary Examiner* — Max Noori
(74) *Attorney, Agent, or Firm* — Muncy, Geissler, Olds & Lowe, PLLC

(57) ABSTRACT

A ball movement path measuring method includes the steps of: preparing an operating unit and a measurement unit, mounting the triaxial accelerometer in the object to be measured for enabling the triaxial accelerometer to define XYZ triaxial space coordinates, obtaining the data of a initial position of the XYZ axes at a first measuring time and the data of a reference position of the XYZ axes at a second measuring time and transmitting the obtained data to the operating unit, and comparing the reference position to the initial position and calculating the XYZ acceleration data, XYZ vector components of force and torsion force relative to each of XYZ axes after receipt of force subject to the contained angle between the coordinates data of the reference position and the coordinate data of the initial position and then using the XYZ acceleration data and the data of the weight and size of the object to calculate the force experienced by the object, initial velocity, flight duration, flight height, flight distance and/or rotation speed.

11 Claims, 2 Drawing Sheets

BALL MOVEMENT PATH MEASURING METHOD

BACKGROUND OF THE INVENTION

1. Field of the Invention

The present invention relates to a method for measuring the movement path of an object and more particularly, to a ball movement path measuring method.

2. Description of the Related Art

Normally, when wishing to know the movement path of an object such as golf ball or baseball ball that experiences a force during a ball game training or measurement, an immovable measuring reference must be established. In this case, the ball may be set in an apparatus that has a fixed measuring axis. For example, U.S. Pat. No. 6,551,194, entitled "Captive ball golf practice tee with three-dimension velocity and two-axis spin measurement" teaches measurement of movement and rotation of ball caused by a force by means of a fixed measuring axis. This measuring method can obtain some basic data required. However, the fixed measuring axis limits the degree of freedom of the ball when the ball experiences a force. Thus, the measured data may be deviated from the possible condition of movement when the ball experienced a force.

SUMMARY OF THE INVENTION

The present invention has been accomplished under the circumstances in view. It is the main object of the present invention to provide a ball movement path measuring method, which enables the object to move freely when experiences a force, thereby obtaining the data of XYZ acceleration data, XYZ vector components of force and torsion force relative to each of XYZ axes that are close to the actual condition of movement of the object.

To achieve this and other objects of the present invention, a ball movement path measuring method comprises the steps of preparing an operating unit and a measurement unit, the operating unit being an electronic apparatus having computing and display functions, the operating unit having stored in a memory therein the weight and size data of the object to be measured, the measurement unit being a triaxial accelerometer connectable to the operating unit and adapted for transmitting the measured data to the operating unit; mounting the triaxial accelerometer in the object to be measured for enabling the triaxial accelerometer to define XYZ triaxial space coordinates; obtaining the data of a initial position of the XYZ axes at a first measuring time and transmitting the data to the operating unit, and then obtaining the data of a reference position of the XYZ axes at least one second measuring time and then transmitting the data to the operating unit; comparing the reference position to the initial position and calculating the XYZ acceleration data and the XYZ vector components of force and the torsion force relative to each of the XYZ axes after receipt of force subject to the contained angle between the coordinates data of the reference position and the coordinate data of the initial position, and then using the XYZ acceleration data and the data of the weight and size of the object to calculate the force experienced by the object.

DETAILED DESCRIPTION OF THE INVENTION

Figure 1:
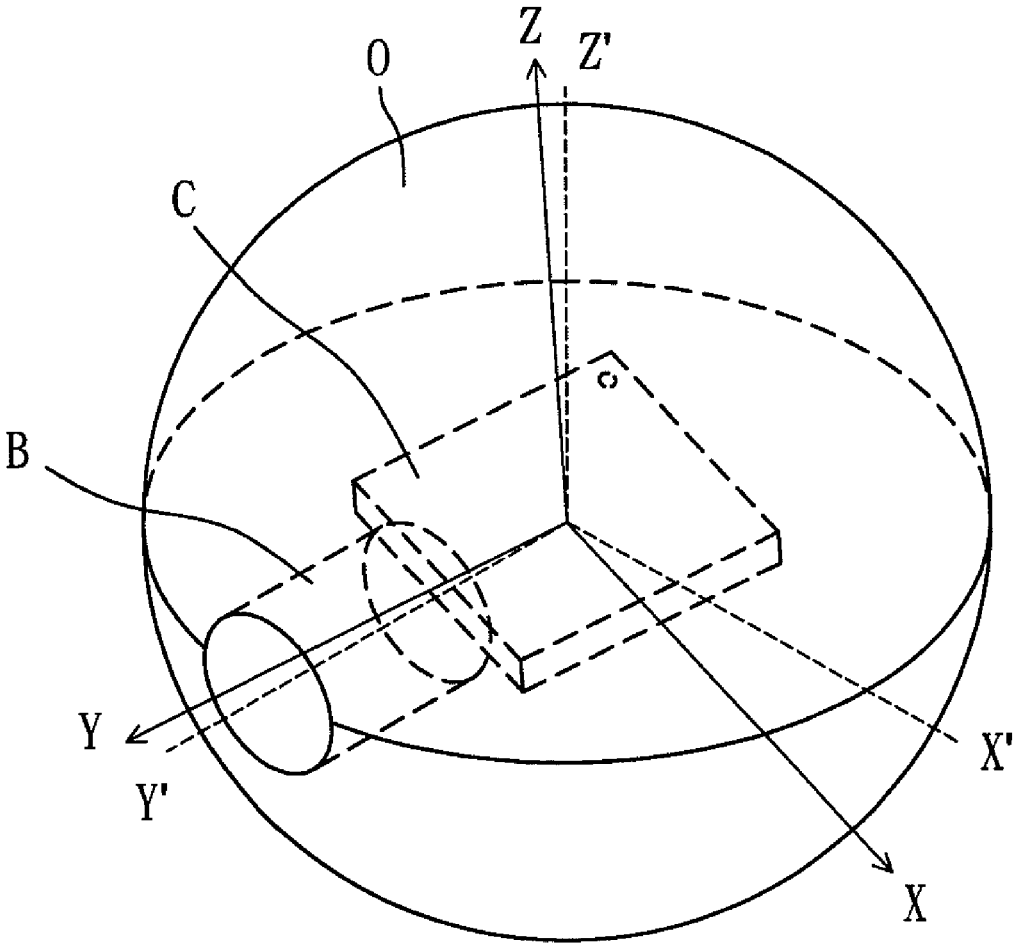
FIG. 1 is a schematic drawing showing the relationship between a triaxial accelerometer and XYZ space coordinates in accordance with the present invention.
Figure 2:
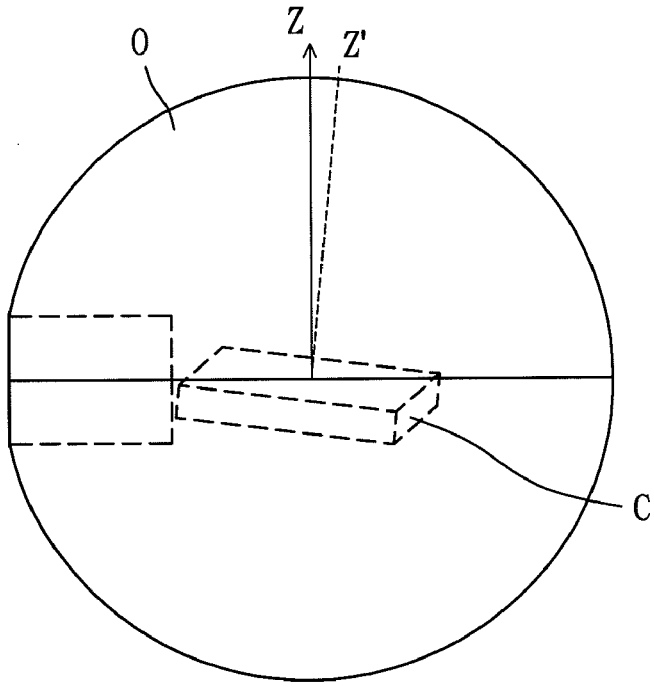
FIG. 2 is a schematic drawing showing the relationship between the absolute coordinates and the relative coordinates in accordance with the present invention.
Figure 3:
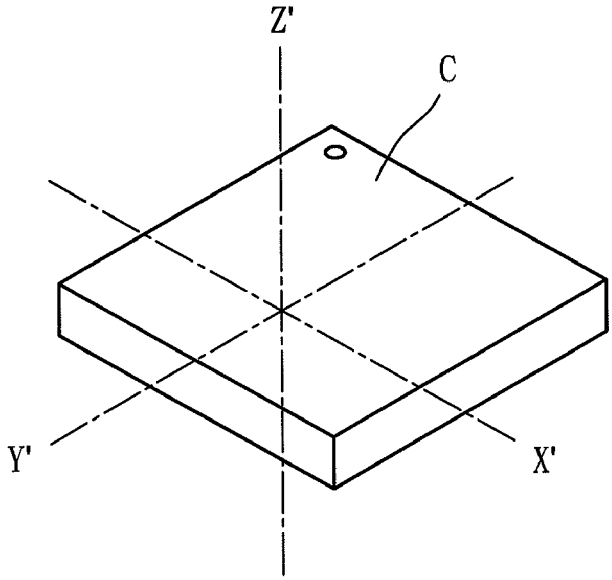
FIG. 3 is a schematic oblique elevation, showing the relationship between the absolute coordinates and the relative coordinates in accordance with the present invention.

Referring to FIGS. 1~3, ball movement path measuring method in accordance with the present invention comprises the steps as follows:

At first, prepare an operating unit and a measurement unit. The operating unit can be a computer, PDA, cell phone or any electronic device having calculation and display functions. Further, the operating unit comprises a memory that has stored therein weight and size data of the object O to be measured. The measurement unit is a triaxial accelerometer C connectable to the operating unit by a wired communication method. Alternatively, the triaxial accelerometer C of the measurement unit can be equipped with a battery and connectable to the operating unit by a wireless communication method.

Thereafter, set the triaxial accelerometer C in the object O to be measured, as shown in FIG. 1. Preferably, the triaxial accelerometer C is located on the center of gravity of the object O. When the triaxial accelerometer C is moved or rotated, its internal microstructure is changed, causing a capacitance variation, which is then converted into a specific output voltage signal for output. The triaxial accelerometer C defines XYZ triaxial space coordinates, as shown in FIG. 1. Because the triaxial accelerometer C is fixedly mounted in the object O, the generation of the XYZ triaxial space coordinates defines the positions of different parts of the object O in the space.

Thereafter, obtain the data of the initial position of the XYZ axes at the first measuring time where the coordinate data of the initial position of the XYZ axes is obtained before the object O experiences a force when the measuring time is zero and then the obtained data is transmitted to the operating unit. And then, obtain the data of a reference position of the XYZ axes at least one second measuring time. A predetermined length of time after the object O experienced a force, the position XYZ is changed, for example, moved to the position X'Y'Z', as indicated by the imaginary line in FIG. 1. Measure the position X'Y'Z' at this second measuring time to obtain the data of this reference position of the XYZ axes, and then transmit the measured data to the operating unit. The length of time between the first measuring time and the second measuring time is determined subject to a predetermined setting.

Thereafter, compare the reference position X'Y'Z' to the initial position XYZ, and calculate XYZ acceleration data and XYZ vector components of force and the torsion force relative to each of XYZ axes after receipt of force subject to the contained angle between the coordinates data of the reference position X'Y'Z' and the coordinate data of the initial position XYZ. Based on the XYZ acceleration data and the basic reference data of the weight and size of the object O, the force experienced by the object O and the initial velocity are obtained by the second law of motion, i.e., a body experiencing a force F experiences an acceleration a related to F by F=ma, where m is the mass of the object O. Based on the initial velocity, we can obtain the data of: flight duration $$\left(t = \frac{2V_o}{g}\right),$$

flight height $$\left(H = \frac{V_o^2}{2g}\right),$$

flight distance $$\left(S = V_o t - \frac{1}{2}gt^2\right)$$

and rotation speed.

According to the present invention, the timeline positions of the first measuring time and the second measuring time and the length of time between the first measuring time and the second measuring time can be determined subject to different settings. For example, the first measuring time can be set at a time point prior to the object experienced an external force, and the second measuring time can be set at 0.5 second after the object experiences an external force. Alternatively, first measuring time can be set at 0.1 second after the object experienced an external force, and the second measuring time can be set at 0.5 second after the object experienced an external force.

The setting of the predetermined length of time can be the data measured from the start point till the end point of a predetermined length of time started from the time moment the object is stricken by a force. For example, measure the start position before the object experiences a force, and then measure the reference position 0.5 second after the object experienced a force. Alternatively, it can measure the data continuously after the object experienced a force. For example, the first measuring time can be a time point before the object experiences a force and the second measuring time can be any time point 0.1 second after the object experienced a force, or, the first measuring time can be a time point before the object experiences a force and the second measuring time, third measuring time and etc. can be the time points of equal time interval within a predetermined length of time after the object experienced a force. For example, the measurement at the second measuring time, third measuring time and etc. can be performed five times at a time interval of 0.02 second within the length of time 0.1 second.

The triaxial accelerometer C can be connected to a connection line through a connection port B thereof to obtain the necessary working power from an external power source and to output the measured data. Alternatively, the triaxial accelerometer C can be made having a built-in battery and adapted for outputting the measured data by a wireless transmission method.

Subject to the data measured, the acceleration, flight path, flight duration, and direction and angle of rotation can be obtained through a computation. The measuring method of the present invention eliminates the problem of a fixed measuring axis i.e., eliminates the factors that limit free movement of the object. Further, it is not necessary to reposition the object and to reset the reference position upon each calculation. The measuring method of the present invention can obtain data close to the actual movement of the object, assuring high accuracy of evaluation of the acceleration, flight path, flight duration and angle and direction of rotation of the object when the object experiences a force.

What is claimed is:

1. A ball movement path measuring method, comprising the steps of:

preparing an operating unit and a measurement unit, said operating unit being an electronic apparatus having computing and display functions, said operating unit having stored in a memory therein the weight and size data of said ball, said measurement unit being a triaxial accelerometer connectable to said operating unit and adapted for transmitting the measured data to said operating unit;

mounting said triaxial accelerometer in said ball for enabling said triaxial accelerometer to define XYZ triaxial space coordinates;

obtaining the data of a initial position of the XYZ axes at a first measuring time and transmitting the data to said operating unit, and then obtaining the data of a reference position of the XYZ axes at least one second measuring time and then transmitting the data to said operating unit;

comparing the reference position to the initial position and calculating the XYZ acceleration data after receipt of force subject to the contained angle between the coordinates data of the reference position and the coordinate data of the initial position, and then using the XYZ acceleration data and the data of the weight and size of the said object to calculate the force experienced by the said object.

2. The ball movement path measuring method as claimed in claim 1, wherein the time points of said first measuring time and said at least one second measuring time is within the start point and end point of a predetermined length of time after said ball experienced a force.

3. The ball movement path measuring method as claimed in claim 1, wherein the time point of said first measuring time is a time point before said ball experiences a force; the time point of each said second measuring time is a time point after said ball experienced a force.

4. The ball movement path measuring method as claimed in claim 1, wherein the time point of said first measuring time is a time point after a first predetermined length of time after said ball experienced a force; the time point of each said second measuring time is a time point after a second predetermined length of time started after said first predetermined length of time.

5. The ball movement path measuring method as claimed in claim 1, wherein said triaxial accelerometer comprises a connection port connected to a connection line set and adapted for obtaining the necessary working power from an external power source and outputting measured data.

6. The ball movement path measuring method as claimed in claim 1, wherein said triaxial accelerometer has a built-in battery and configured to output measured data wirelessly.

7. The ball movement path measuring method as claimed in claim 1, wherein said triaxial accelerometer is configured to use the measured XYZ acceleration data and the basic reference data of the weight and size of said ball for calculating at least one of the data of initial velocity, flight duration, flight height, flight distance and rotation speed.

8. The ball movement path measuring method as claimed in claim 1, further calculating the XYZ vector components of force to calculate the force experienced by the ball.

9. The ball movement path measuring method as claimed in claim 8, further calculating the torsion force relative to each of the XYZ axes to calculate the force experienced by the ball.

10. The ball movement path measuring method as claimed in claim 1, further calculating the torsion force relative to each of the XYZ axes to calculate the force experienced by the ball.

11. The ball movement path measuring method as claimed in claim 1, wherein the object to be measured has a spherical shape.

* * * * *